US005156395A

United States Patent [19]

Smith

[11] Patent Number: 5,156,395

[45] Date of Patent: Oct. 20, 1992

[54] ADJUSTABLE BASKETBALL GOAL

[76] Inventor: Philip J. Smith, 1008 Park Ln., Pella, Iowa 50219

[21] Appl. No.: 811,115

[22] Filed: Dec. 20, 1991

[51] Int. Cl.[5] ..... A63B 63/08

[52] U.S. Cl. ..... 273/1.5 R; 248/188.4; 248/295.1

[58] Field of Search ..... 273/1.5 R, 1.5 A; 254/97, 96; 248/295.1, 188.4; 362/431, 418

[56] References Cited

U.S. PATENT DOCUMENTS

| | | | |
|---|---|---|---|
| 1,526,153 | 2/1925 | Kinney | 254/97 |
| 2,099,487 | 11/1937 | Johnson et al. | 254/97 |
| 2,364,155 | 12/1944 | Martineau | 248/295.1 X |
| 2,383,204 | 8/1945 | Le Veque | 254/97 |
| 2,986,395 | 5/1961 | Sheftel | 273/1.5 R |
| 3,329,427 | 7/1967 | Bearson | 273/1.5 R |
| 3,427,025 | 2/1969 | Procter | 273/1.5 R |
| 3,671,738 | 6/1972 | Beachley | 362/431 |
| 3,776,549 | 12/1973 | Ganis | 273/1.5 R |
| 4,093,181 | 6/1978 | Ivins | 254/97 |
| 4,412,679 | 11/1983 | Mahoney et al. | 273/1.5 R |
| 4,522,394 | 6/1985 | Broussard | 273/1.5 R |
| 4,801,142 | 1/1989 | Freisen | 273/1.5 R |
| 4,941,661 | 7/1990 | Lykens | 273/1.5 R |
| 4,951,944 | 8/1990 | Morgan | 273/1.5 R |

OTHER PUBLICATIONS

The Sporting Goods Dealer Jun. 1975 p. 61 Diversified Products Corporation Advertisement.

*Primary Examiner*—Paul E. Shapiro
*Attorney, Agent, or Firm*—Henderson & Sturm

[57] ABSTRACT

An adjustable height basketball goal including a vertical column having angled corners and a beam extending up from the column. The upper end of the beam supports a basketball goal and the lower end is attached to the column by a movable collar. The collar carries a first set of rollers disposed to contact the angled corners at a first elevation, and a second set of rollers disposed to contact the angled corners at a second lower elevation. The rollers allow easy movement of the collar with respect to the column while firmly securing the beam against wobbling. A vertical adjustment mechanism, such as a rack and gear assembly selectively moves the collar with respect to the column to adjust the height of the basketball goal above the playing surface.

18 Claims, 2 Drawing Sheets

ADJUSTABLE BASKETBALL GOAL

TECHNICAL FIELD

This invention relates to sporting devices, and more particularly to an adjustable height basketball goal.

BACKGROUND ART

Several adjustable height basketball goals are shown in the prior art, but none to date have been commercially successful, due top various problems. Complicated structures are characteristic of the known devices and many include telescoping sections that bind and make operation difficult if not impossible.

Those concerned with these and other problems recognize the need for an improved adjustable height basketball goal.

DISCLOSURE OF THE INVENTION

The present invention provides an adjustable height basketball goal including a vertical column having angled corners and a beam extending up from the column. The upper end of the beam supports a basketball goal and the lower end is attached to the column by a movable collar. The collar carries a first set of rollers disposed to contact the angled corners at a first elevation, and a second set of rollers disposed to contact the angled corners tat a second lower elevation. The rollers allow easy movement of the collar with respect to the column while firmly securing the beam against wobbling. A vertical adjustment mechanism, such as a rack and gear assembly selectively moves the collar with respect to the column to adjust the height of the basketball goal above the playing surface.

An object of the present invention is the provision of an improved adjustable height basketball goal.

Another object is to provide an adjustable basketball goal having an uncomplicated structure.

A further object of the invention is the provision of an adjustable basketball goal that is easy and safe to operate.

Still another object is to provide an adjustable basketball goal that is durable.

A still further object of the present invention is the provision of an adjustable basketball goal that is secured against wobbling.

BRIEF DESCRIPTION OF THE DRAWINGS

These and other attributes of the invention will become more clear upon making a thorough review and study of the following description of a preferred embodiment, particularly when reviewed in conjunction with the drawings, wherein.

BEST MODE FOR CARRYING OUT THE INVENTION

Figure 1:
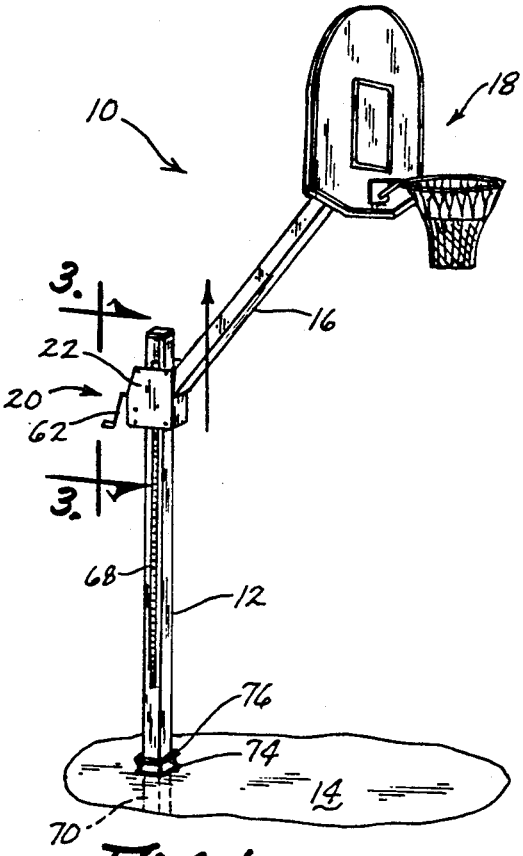
FIG. 1 is a perspective view of the adjustable basketball goal of the present invention showing the goal at one elevation above the playing surface.

Referring now to the drawings, wherein like reference numerals designate identical or corresponding parts throughout the several views, FIG. 1 shows the adjustable height basketball goal (10) of the present invention including a vertical column (12) formed of square steel tubing extending above the basketball playing surface (14). A beam (16) extends upwardly and outwardly from the column (12) and the upper end of the beam (16) supports a conventional basketball goal (18). The lower end of the beam (16) is attached to the column (12) by a movable collar (20).

Figure 3:
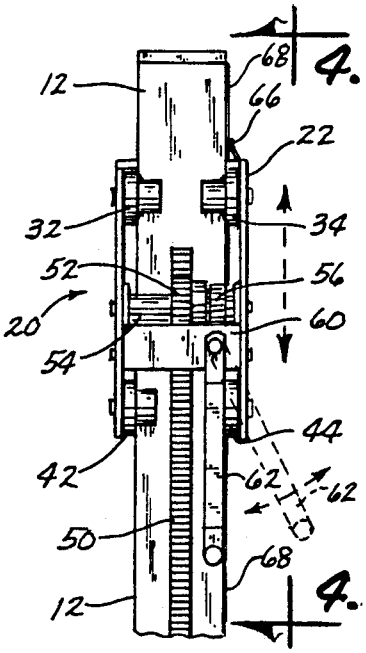
FIG. 3 is an enlarged partial rear elevational view taken along line 3—3 of FIG. 1.
Figure 4:
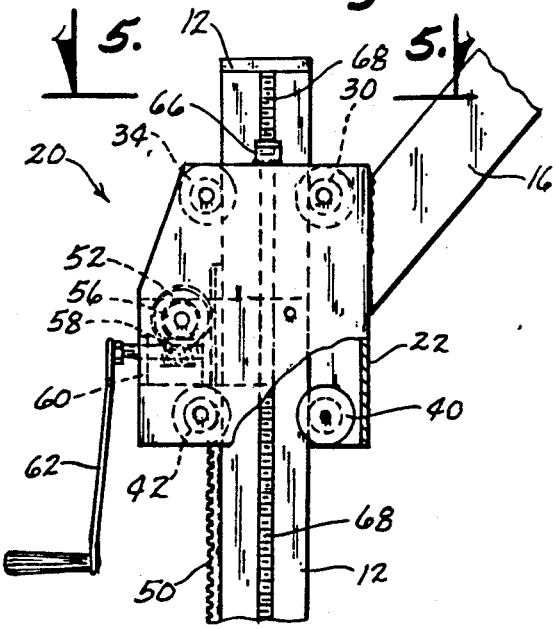
FIG. 4 is a partial side elevational view taken along line 4—4 of FIG. 3 with portions cut away to show engagement of a roller on one corner of the column.
Figure 5:
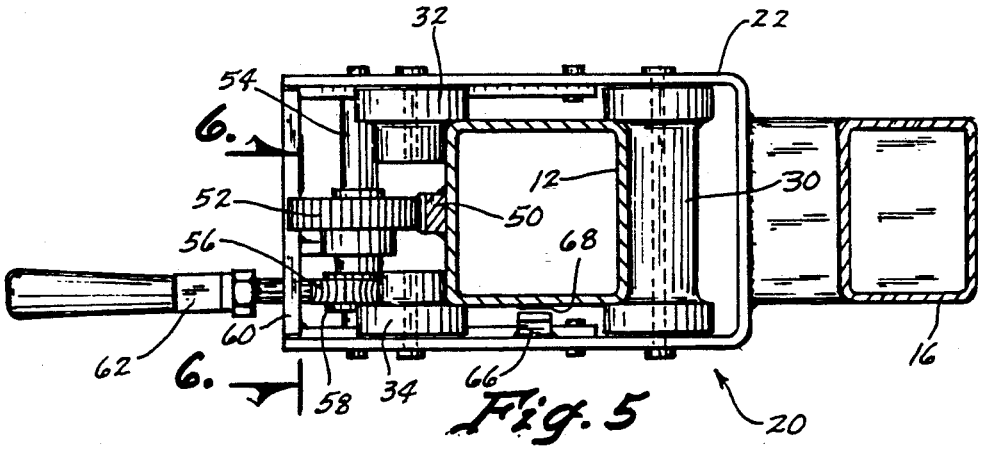
FIG. 5 is an enlarged top plan sectional view taken along line 5—5 of FIG. 4.

As best shown in FIGS. 3–5, the collar (20) includes a U-shaped bracket (22) that is welded to the lower end of the beam (16). A first set of rollers (30, 32 and 34) are rotatably attached to an upper portion of bracket (22) and are disposed to contact the corners of the column (12) at a first elevation. A second set of rollers (40, 42 and 44) are rotatably attached to the lower portion of the bracket (22) and are disposed to contact the corners of the column (12) at a second lower elevation. The arrangement of the rollers facilitates movement of the collar (20) up and down the column (12) while preventing the beam (16) from wobbling.

Figure 6:
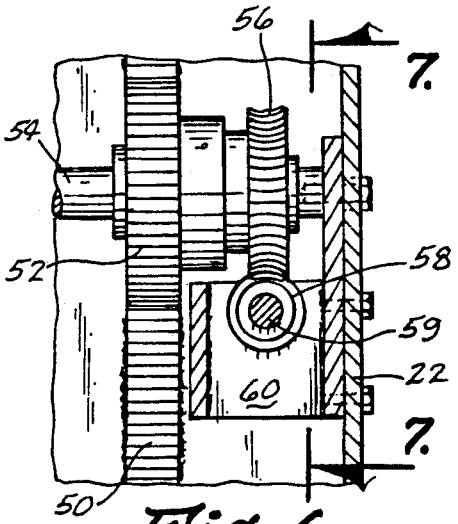
FIG. 6 is an enlarged rear elevational sectional view taken along line 6—6 of FIG. 5.
Figure 7:
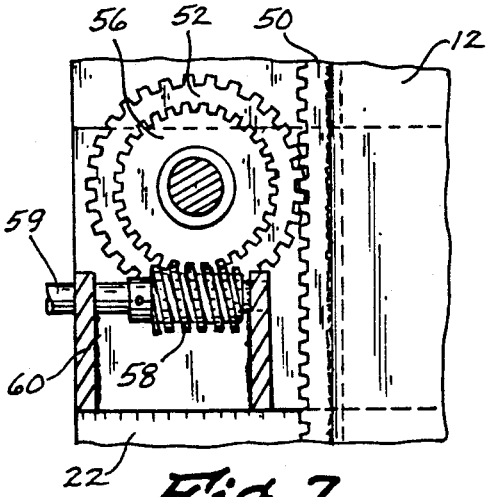
FIG. 7 is a side elevational sectional view taken along line 7—7 of FIG. 6.

The collar (20) is selectively moved along the column by a rack and gear mechanism. A vertical rack (50) is attached to the column (12) and a mating gear (52) is rotatably attached by a shaft (54) to the bracket (22). As shown in FIGS. 6 and 7, the mating gear (52) is driven by a worm and worm gear arrangement. The worm gear 956) is mounted on the shaft (54) and the worm (58) is attached to a shaft (59) rotatably mounted on the mounting plate (60). A crank handle (62) is attached to the end of the shaft (59) and rotation of the handle (62) causes the collar (20) to move with respect to the column (12). The worm and worm gear arrangement allows the collar (20) to be securely positioned at any elevational on the column (12) without the need for a separate locking mechanism.

Figure 2:
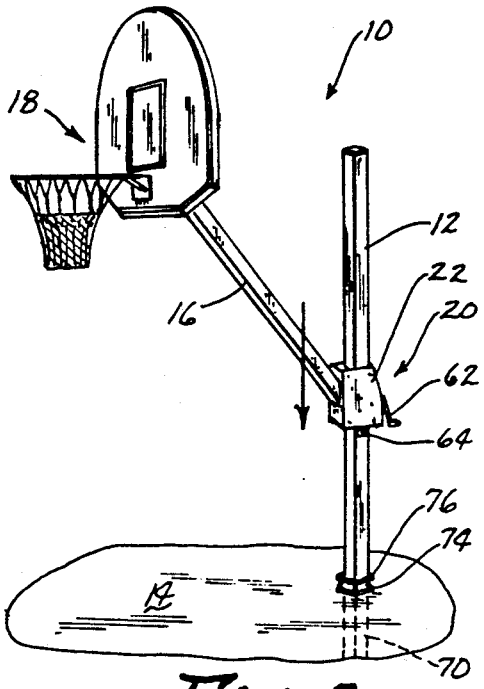
FIG. 2 is a perspective view of the adjustable basketball goal similar to FIG. 1 but showing the goal at a lowered elevation.

The height of the basketball goal (18) above the playing surface (14) can be selectively adjusted between the lowest position (FIG. 2) where the collar (20) contacts a lower stop(64), and the highest position where the mating bar (52) reaches the top end of the rack (50). A pointer (66) is attached to the collar (20) and a scale (68) extends along the column (12). The height of the goal (18) is indicated by the relative position of the pointer (66) with respect to the scale (68).

Figure 8:
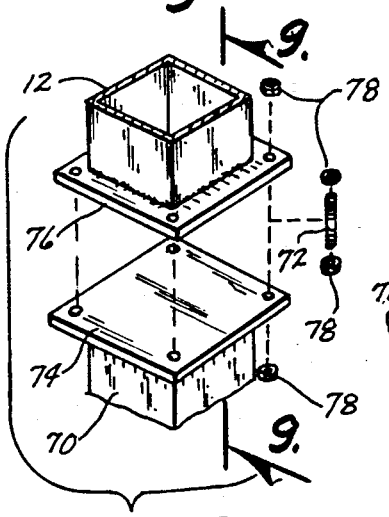
FIG. 8 is a partial exploded perspective view showing the support base and the bottom of the column.
Figure 9:
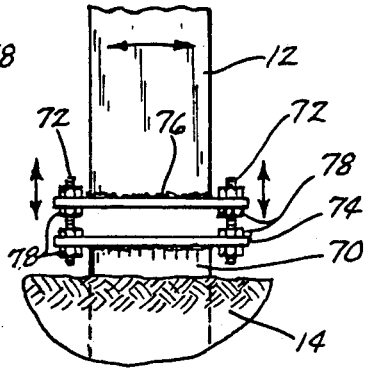
FIG. 9 is a partial side elevational view showing the base and column attached by elevational fasteners.

As best shown in FIGS. 8 and 9, the column (12) includes a leveling mechanism to secure it in its vertical position. A base (70) is anchored in the ground with the upper end disposed generally at the elevation of and adjacent to the playing surface 914). Threaded studs (72) are attached to and extend up from a flange (74) at the top of the base 970). A mating flange (76) is attached to the bottom of the column (12) and includes openings disposed to receive the upper portions of the studs (72). Fasteners (78) are threaded on the studs (72) both above and below the mating flange (76). The fasteners (78) are then adjusted to position and secure the column in its vertical orientation.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. An adjustable basketball goal, comprising:

a vertical column disposed to extend above a basketball playing surface, said column being formed of square tubing;

a beam extending upwardly from the column, the beam being disposed to support a basketball goal at its upper end, and being attached at its lower end to the column via a movable collar;

the movable collar including:

a first set of rollers rotatably attached to an upper portion of the bracket and disposed to contact the column at a first elevation, wherein the first set of rollers includes rollers disposed on axes parallel to each other on opposite sides of the column, each of the rollers being disposed to contact corners of the column at the first elevation; and a second set of rollers rotatably attached to a lower portion of the bracket and disposed to contact the column at a second lower elevation; and adjusting means for vertically moving the collar with respect to the column, whereby the height of the basketball goal above the playing surface is selectively adjusted.

2. The basketball goal of claim 1, further including leveling means for securing the column in a vertical orientation.

3. The basketball goal of claim 2 wherein the leveling means includes:

a base having an upper end disposed generally at the elevation of the playing surface, the upper end of the base including a number of upwardly extending threaded shafts;

a flange attached to the bottom of the column, the flange including a number of openings disposed to receive the threaded shafts; and threaded fasteners disposed to engage each of the threaded shafts both above and below the flange, whereby adjustment of the fasteners levels the column and secures it in its vertical orientation.

4. The basketball goal of claim 1, further including indicator means for displaying the height of the basketball goal above the playing surface.

5. The basketball goal of claim 4 wherein the indicator means includes:

indicia disposed to extend vertically along the column; and a pointer attached to the collar and disposed in near proximity to the indicia, whereby the location of the pointer with respect to the indicia indicates the height of the basketball goal above the playing surface.

6. The basketball goal of claim 1 wherein the square tubing is made of steel.

7. The basketball goal of claim 1 wherein the second set of rollers includes second rollers disposed on axes parallel to each other on opposite sides of the column, each of the rollers being disposed to contact corners of the column at the second lower elevation.

8. The basketball goal of claim 1 wherein the adjusting means includes:

a vertical rack attached to the column;

a gear rotatably attached by a shaft to the collar and disposed to engage the rack; and drive means for rotating the gear to cause it to move with respect to the rack.

9. The basketball goal of claim 8 wherein the drive means includes:

a worm gear attached to the shaft;

a worm rotatably attached to the collar and disposed at a right angle to the shaft to engage the worm gear; and a crank handle attached to the worm and disposed to extend out from the collar, whereby rotation of the handle results in movement of the collar with respect to the column and inadvertent vertical movement of the collar is prevented by the worm and worm gear arrangement.

10. An adjustable basketball goal, comprising:

a vertical column disposed to extend above a basketball playing surface, said column being formed of square tubing;

a beam extending upwardly from the column, the beam being disposed to support a basketball goal at its upper end, and being attached at its lower end to the column via a movable collar;

the movable collar including:

a first set of rollers rotatably attached to an upper portion of the bracket and disposed to contact the column at a first elevation; and a second set of rollers rotatably attached to a lower portion of the bracket and disposed to contact the column at a second lower elevation, wherein the second set of rollers includes second rollers disposed on axes parallel to each other on opposite sides of the column, each of the rollers being disposed to contact corners of the column at the second lower elevation; and adjusting means for vertically moving the collar with respect to the column, whereby the height of the basketball goal above the playing surface is selectively adjusted.

11. The basketball goal is claim 10, further including levelling means for securing the column in a vertical orientation.

12. The basketball goal of claim 11 wherein the leveling means includes:

a base having an upper end disposed generally at the elevation of the playing surface, the upper end of the base including a number of upwardly extending threaded shafts;

a flange attached to the bottom of the column, the flange including a number of openings disposed to receive the threaded shafts; and threaded fasteners disposed to engage each of the threaded shafts both above and below the flange, whereby adjustment of the fasteners levels the column and secures it in its vertical orientation.

13. The basketball goal of claim 10, further including indicator means for displaying the height of the basketball goal above the playing surface.

14. The basketball goal of claim 13 wherein the indicator means includes:

indicia disposed to extend vertically along the column; and a pointer attached to the collar and disposed in near proximity to the indicia, whereby the location of the pointer with respect to the indicia indicates the height of the basketball goal above the playing surface.

15. The basketball goal of claim 10 wherein the square tubing is made of steel.

16. The basketball goal of claim 10 wherein the first set of rollers includes rollers disposed on axes parallel to each other on opposite sides of the column, each of the rollers being disposed to contact corners of the column at the first elevation.

17. The basketball goal of claim 10 wherein the adjusting means includes:

a vertical rack attached to the column;

a gear rotatably attached by a shaft to the collar and disposed to engage the rack; and drive means for rotating the gear to cause it to move with respect to the rack.

18. The basketball goal of claim 17 wherein the drive means includes:

a worm gear attached to the shaft;

a worm rotatably attached to the collar and disposed at a right angle to the shaft to engage the worm gear; and a crank handle attached to the worm and disposed to extend out from the collar, whereby rotation of the handle results in movement of the collar with respect to the column and inadvertent vertical movement of the collar is prevented by the worm and worm gear arrangement.

* * * * *